US006739892B1

(12) United States Patent
Belopolsky et al.

(10) Patent No.: US 6,739,892 B1
(45) Date of Patent: May 25, 2004

(54) MODULAR CONNECTOR FOR VERY HIGH FREQUENCY APPLICATIONS

(75) Inventors: Yakov Belopolsky, Harrisburg, PA (US); David C. Horchler, Millersburg, PA (US); David F. Fusselman, Middletown, PA (US)

(73) Assignee: FCI Americas Technology, Inc., Reno, NV (US)

( * ) Notice: Subject to any disclaimer, the term of this patent is extended or adjusted under 35 U.S.C. 154(b) by 66 days.

(21) Appl. No.: 09/841,225

(22) Filed: Apr. 24, 2001

(51) Int. Cl.[7] ..... H01R 29/00
(52) U.S. Cl. ..... 439/188
(58) Field of Search ..... 439/188, 78, 81, 439/82, 83, 676, 941, 166, 173

(56) References Cited

U.S. PATENT DOCUMENTS

| | | | | |
|---|---|---|---|---|
| 4,497,526 A | | 2/1985 | Myers | 339/17 LC |
| 4,556,264 A | | 12/1985 | Tanaka | 339/17 LC |
| 4,647,136 A | | 3/1987 | Kinoshita et al. | 339/125 R |
| 5,037,316 A | | 8/1991 | Fukushima et al. | 439/83 |
| 5,269,708 A | | 12/1993 | DeYoung et al. | 439/676 |
| 5,626,497 A | | 5/1997 | Bouchan et al. | 439/676 |
| 5,697,817 A | | 12/1997 | Bouchan et al. | 439/676 |
| 5,704,797 A | * | 1/1998 | Meyerhoefer et al. | 200/51.12 |
| 5,971,813 A | * | 10/1999 | Kunz et al. | 439/676 |
| 6,162,077 A | | 12/2000 | Laes et al. | 439/188 |
| 6,171,152 B1 | * | 1/2001 | Kunz | 439/620 |
| 6,231,397 B1 | * | 5/2001 | de la Borbolla et al. | 439/676 |
| 6,394,853 B1 | * | 5/2002 | Hammond et al. | 439/676 |

* cited by examiner

*Primary Examiner*—P. Austin Bradley
*Assistant Examiner*—Edwin A. Leon
(74) *Attorney, Agent, or Firm*—Woodcock Washburn LLP

(57) ABSTRACT

A modular jack for receiving complimentary plugs. The jack comprises a ground shield, a dielectric housing, a shield insert, a switching block, a circuit board sub-assembly, a plurality of terminal contacts, and a plurality of switching contacts. The ground shield has a plug receiving face that is open to expose a plug receiving cavity and is adapted to receive a complimentary plug. The ground shield also has a mounting face which defines grounding springs that extend inward towards the plurality of switching contacts. Portions of some of the terminal contacts extend in cantilever fashion into the plug receiving cavity while portions of some the terminal contacts extend through the ground shield forming terminal posts. A number of the terminal contacts have contact switching pads upon which mating portions of the switching contacts rest. When a plug having a switching protrusion on its lower front surface is inserted in the plug receiving cavity, the switching block slides towards the ground shield mounting face lifting the mating portions of the switching contacts off the contact switching pads until they touch the ground springs extending from the ground shield mounting face.

42 Claims, 11 Drawing Sheets

MODULAR CONNECTOR FOR VERY HIGH FREQUENCY APPLICATIONS

I. BACKGROUND

A. Field of the Invention

The invention relates generally to the field of electrical connectors, and particularly to modular connectors for very high frequency transmissions and methods of using the same.

B. Description of the Related Art

In the industry today standards organizations such as the Telecommunications Industry Association (TIA) and the International Organization for Standardization (ISO) publish performance specifications and equipment configurations for various aspects of electrical cabling, including the electrical connectors or interfaces used with the cabling. Presently there are specifications for six categories of modular jacks used with twisted-pair cabling: Category 3, Category 4, Category 5, Category 5E, Category 6, and Category 7. For Categories 3–6, an 8-position modular jack interface is specified. That is, a Category 3–6 compliant modular jack must have, among other things, 8 parallel terminal contacts that extend into a plug-receiving cavity and are spaced at specific intervals. A number of the parameters specified, such as the size of the terminal contacts and the distances between one another, derive in part from the frequency range of the signals to be passed through the jack and the need to suppress crosstalk among the terminal contacts. For instance, requirements for a Category 3 compliant jack are specified to an upper frequency limit of 16 MHz, to an upper frequency limit of 32 MHZ for a Category 4, to an upper frequency limit of 100 MHz for a Category 5 or 5E, and to an upper frequency limit of 250 MHz for a Category 6 compliant jack.

Presently the performance specifications and equipment configurations for a Category 7 jack are under development by the ISO/IEC, but the requirements are expected to be specified to an upper frequency limit of 600 MHz. Due to this large jump in the upper range of frequencies that a Category 7 jack will accommodate, crosstalk becomes a major concern. For this reason the standards bodies have chosen to abandon the 8-position modular jack interface specified for Categories 3–6 in favor of an 8-position modular jack interface where terminals 1–2, and 7–8 extend into the plug-receiving cavity of the jack from the top and terminals 4–6 extend into the plug-receiving cavity from the bottom. It is also expected however, that the standards bodies will mandate that each Category 7 jack is backwards compatible. That is, that each Category 7 jack must accept Category 2–6 plugs in addition to Category 7 plugs. Thus, there is a need for a way of making a Category 7 jack backwards compatible.

II. SUMMARY OF THE INVENTION

A modular jack connector, comprising a ground shield defining a receiving cavity open at a plug receiving face, a dielectric housing mounted inside the ground shield receiving cavity, the dielectric housing defining a plug receiving cavity open on a first face thereof and an insert receiving cavity open to the plug receiving cavity, a plurality of first terminal contacts mounted to the dielectric housing, each of the first terminal contacts having a spring beam and tail end portion wherein the spring beam portion extends within the plug receiving cavity, a plurality of second terminal contacts mounted to the dielectric housing, each second terminal contact having a spring beam and tail end portion wherein the spring beam portion extends within the plug receiving cavity and wherein certain of the tail end portions of the second in terminal contacts are electrically connected to certain of the tail end portions of the first terminal contacts, and a switching block positioned to slideably move within the insert receiving cavity, whereby insertion of a plug having a switching protrusion into the plug receiving cavity of the connector contacts and moves the switching block away from the plug receiving cavity breaking the electrical connections. Certain of the tail end portions of the second terminals may be electrically connected to the certain of the tail end portions of the first terminal contacts by a plurality of switching contacts. In this case, the electrical connections are broken by the switching block engaging the switching contacts.

III. BRIEF DESCRIPTION OF THE DRAWINGS

These and other features, aspects, and advantages of the present invention will become better understood with regards to the following description, appended claims, and accompanying drawings where:

FIGS. 1A, 1B, and 1C are front, side, and rear views respectively of an embodiment of the invention;

IV. DETAILED DESCRIPTION OF THE PREFERRED EMBODIMENTS

Figure 1C:
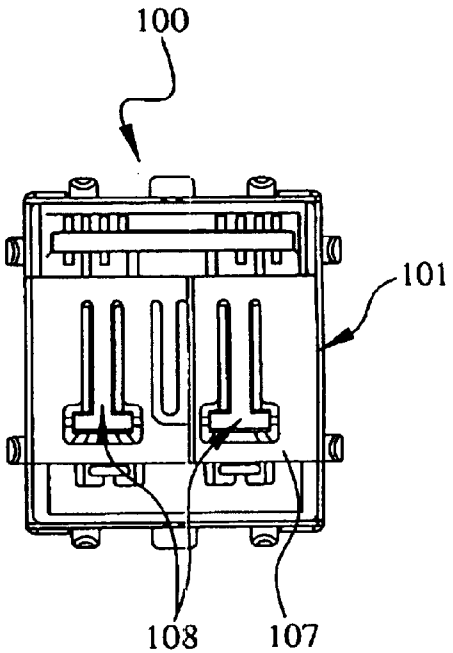
Figure 1B:
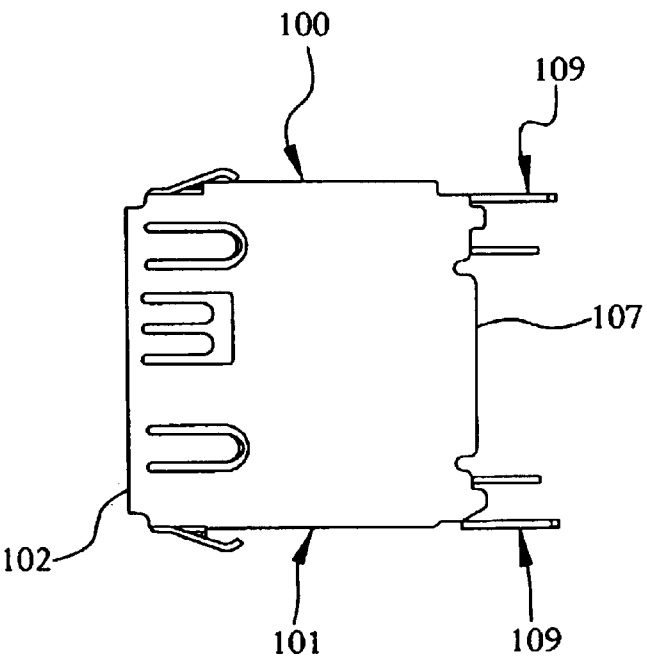
Figure 1A:
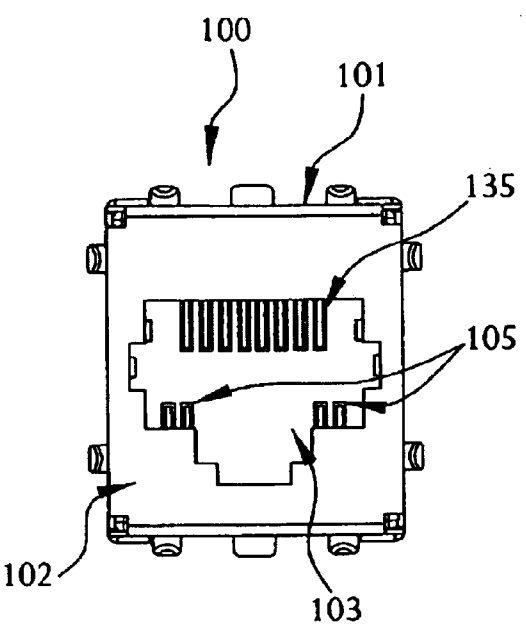

Throughout the following detailed description similar reference numbers refer to similar elements in all the Figures. of the drawings. Referring now to FIGS. 1A–1C, front, side, and rear views respectively of an embodiment of the invention are shown. The invention is embodied in a modular jack type connector generally designated 100. As depicted in the figures, jack 100 is generally cubic in shape and the outermost portion comprises a ground shield 101 defined by six walls. The ground shield is stamped and formed of sheet metal or any other suitable electrically conductive material. The front wall of ground shield 101 defines a plug receiving face 102 and is open to expose a plug receiving cavity 103 that extends inwardly from plug receiving face 102. Plug receiving face 102 is adapted to receive complimentary Category 2–7 plugs. The rear wall of ground shield 101 defines a mounting face 107. Jack 100 is adapted for mounting to a printed circuit board (not shown), and one or more mounting posts 109 project from mounting face 107 for insertion into appropriate mounting holes in the printed circuit board. Mounting face 107 also defines two grounding springs 108 that extend inward from mounting face 107 and at times touch a plurality of switching contacts as will be discussed further below.

Figure 2:
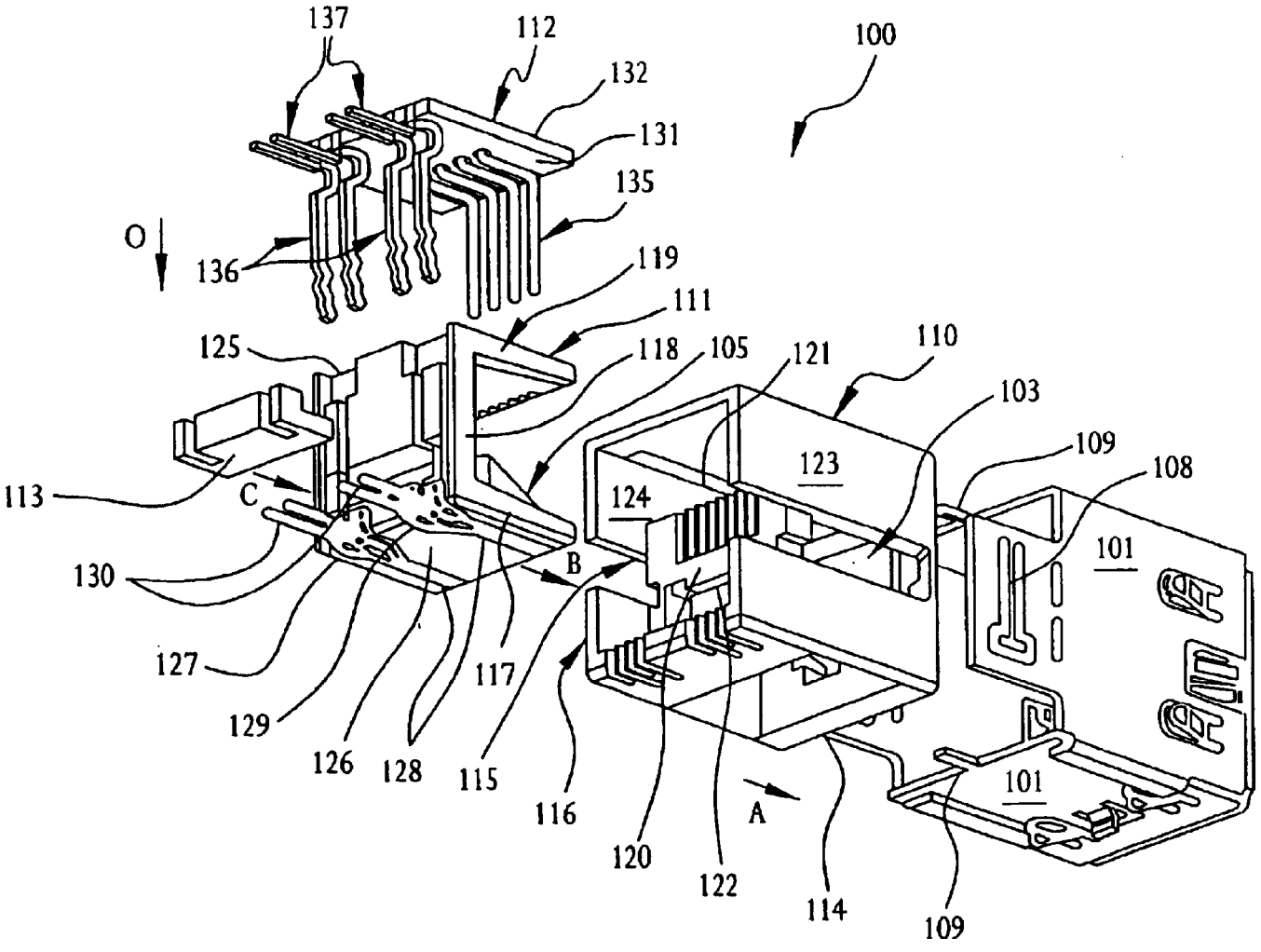
FIGS. 2–7 are perspective views of an embodiment of the invention in various stages of assembly.
Figure 6:
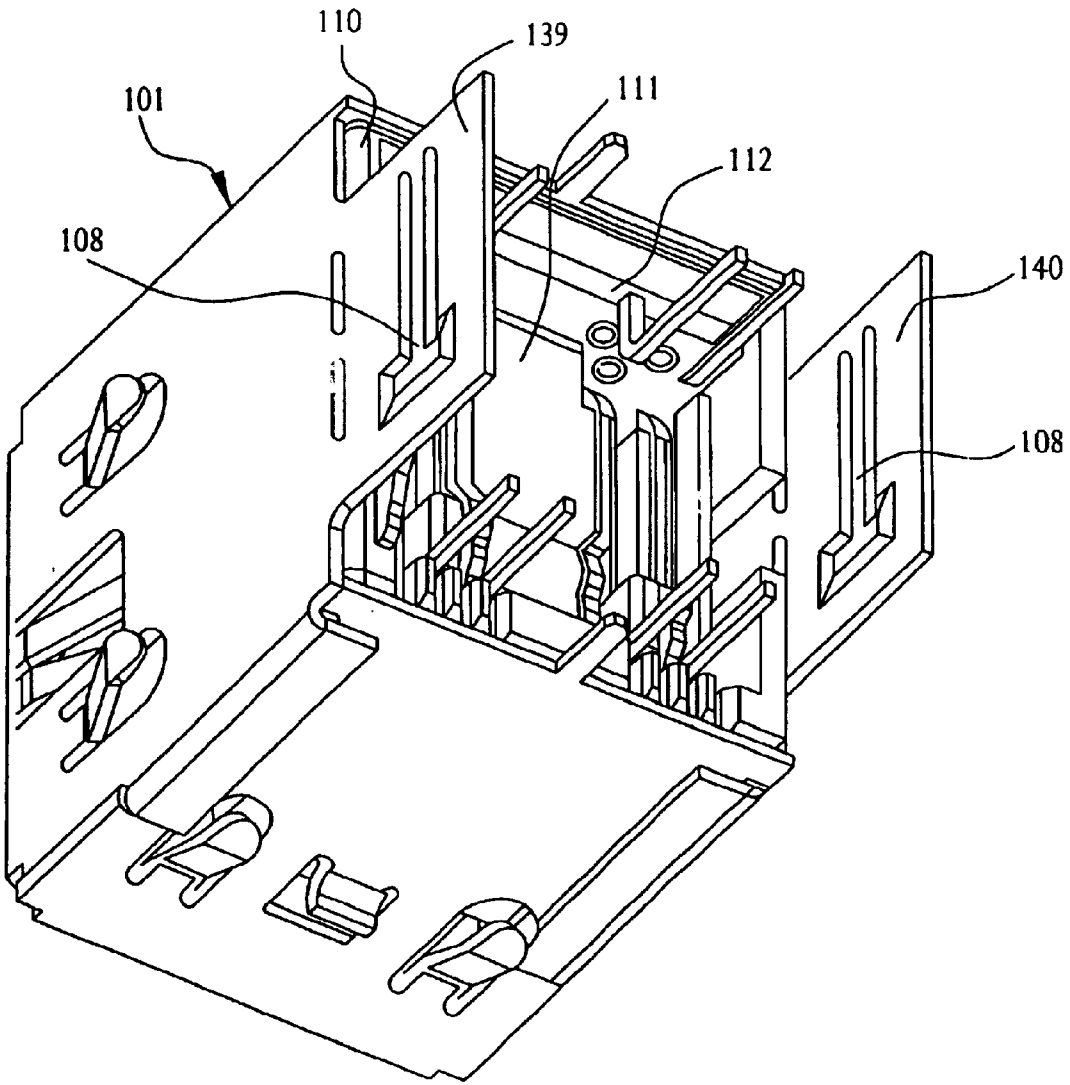

Referring now to FIG. 2 in addition to FIGS. 1A–1C, contained within ground shield 101 are a number of complimentary components including a dielectric housing 110, a shield insert 111, a circuit board sub-assembly 112, and a switching block 113. Dielectric housing 110 is unitarily molded of dielectric material such as plastic or the like in a generally cube-shaped configuration. Dielectric housing 110 defines plug receiving cavity 103 on its front face 114 and an insert receiving cavity 115 open on its rear face 116. Plug receiving cavity 103 and insert receiving cavity 115 are separated from each other in part by internal wall 120, formed at the same time as dielectric housing 110 from the same dielectric material, which extends from the inner surface of housing wall 123 to the inner surface of housing wall 124. Inner cavities 121 and 122 connect the upper and lower portions respectively of plug receiving cavity 103 and insert receiving cavity 115 to one another, and provide spaces through which the first 119 and second 117 walls of shield insert 111 pass during assembly. Dielectric housing 110 is mounted in ground shield 101 by sliding housing 110 in the direction of arrow A. FIG. 6 depicts jack 100 after dielectric housing 110, together with the other complimentary components forming jack 100, is mounted in ground shield 101.

Figure 3:
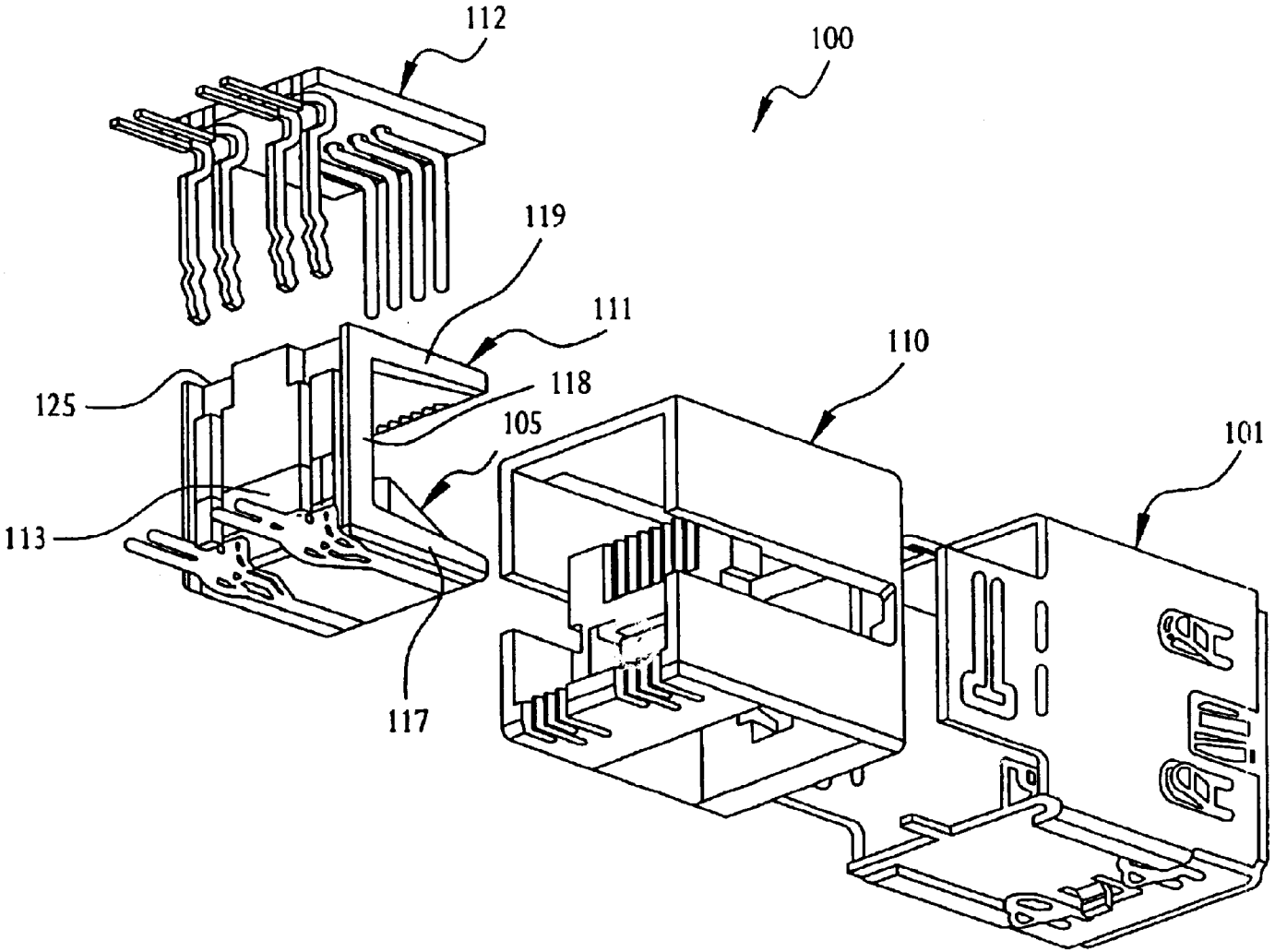

Shield insert 111 is unitarily molded of dielectric material such as plastic or the like in a generally u-shaped configuration having three walls. The first 119 and second 117 walls generally oppose each other and are joined together by the third wall 118 which is transversely oriented to the first 119 and second 118 walls. The outer surface of insert first wall 119 defines a sub-assembly receiving recess 125, and a switching block receiving cavity 127 is open between the inner and outer surfaces of insert third wall 118. Switching block 113 is unitarily molded of dielectric material such as plastic or the like and is slideably mounted in switching block receiving cavity 127 during assembly by inserting block 113 in the direction of arrow C. FIG. 3 depicts jack 100 after switching block 113 has been slideably mounted in switching block receiving cavity 127. Switching block 113 while slideably mounted in cavity 127 can move towards both the front and the rear of jack 100.

Figure 8:
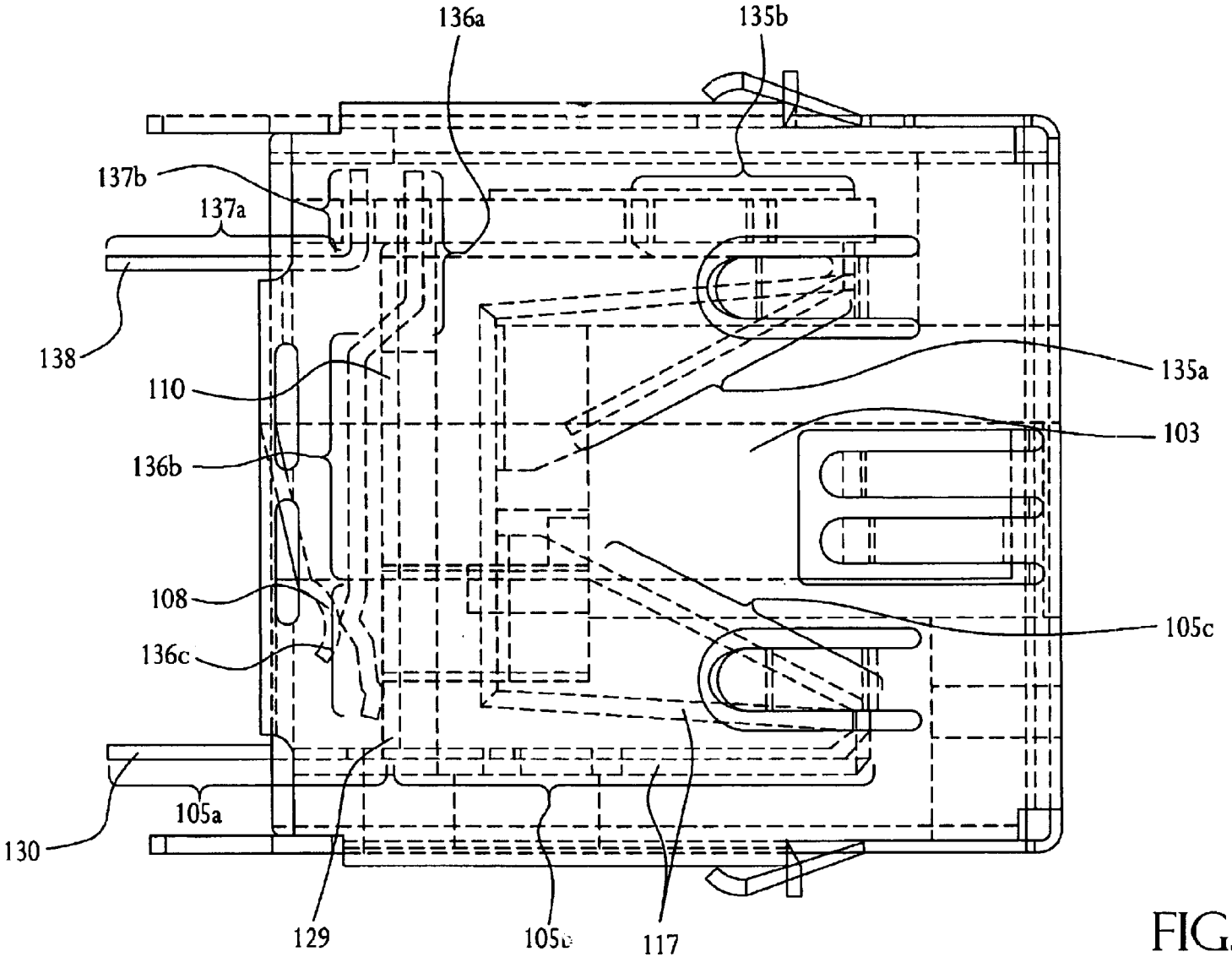
FIG. 8 is a side view of the embodiment of the invention depicted in FIGS. 2–7 with hidden lines illustrating inner components.
Figure 9:
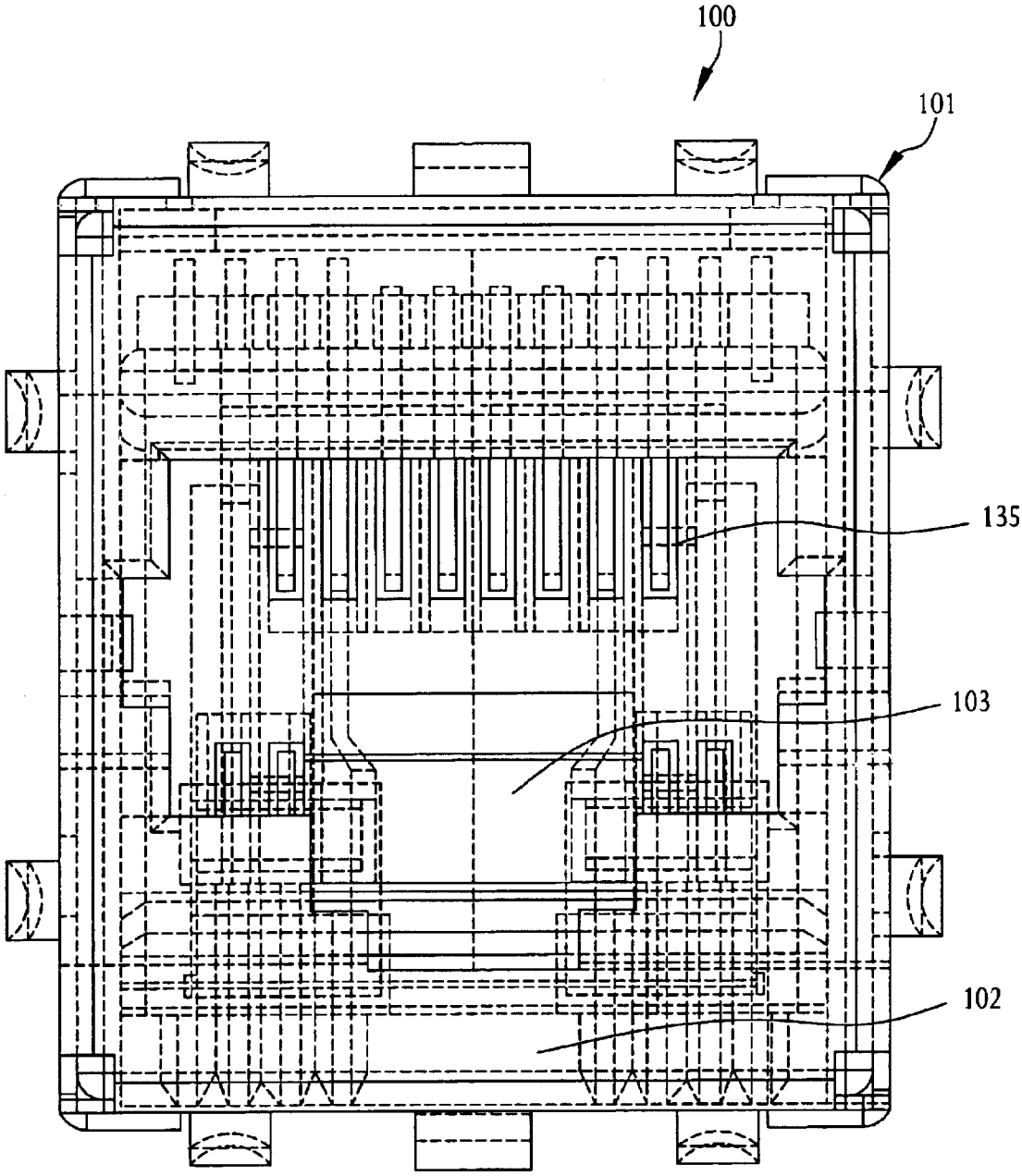
FIG. 9 is a front view of the embodiment of the invention depicted in FIGS. 2–7 with hidden lines illustrating inner components.

The outer surface of insert second wall 117 defines four parallel terminal contact receiving recesses 128. The four recesses 128 run the length of insert second wall 117 front to rear and intersect the inner and outer faces of inert third wall 118. A terminal contact 105 is mounted in each of the terminal contact recesses 128. Referring to FIG. 8, each terminal contact 105 has a spring beam portion 105*a*, an intermediate portion 105*b*, and a tail end portion 105*c*. Each spring beam portion 105*a* of contact 105 extends in cantilever fashion from insert second wall 117 into plug receiving cavity 103, each intermediate portion 105*b* has a switching pad 129 that extends over a lower portion of insert third wall 118, and each tail end portion extends past both insert third wall 118 and through ground shield mounting face 107 to form a terminal post 130.

Referring back again to FIGS. 1–2, each terminal contact recess 128 is spaced substantially apart from the other in the transverse direction, thereby minimizing crosstalk between terminal contacts 105 and obviating the need for a second circuit board sub-assembly mounted to second wall outer face 126. Terminal contacts 105 correspond to terminal positions 3–6 of a category 7 compliant jack.

Figure 10:
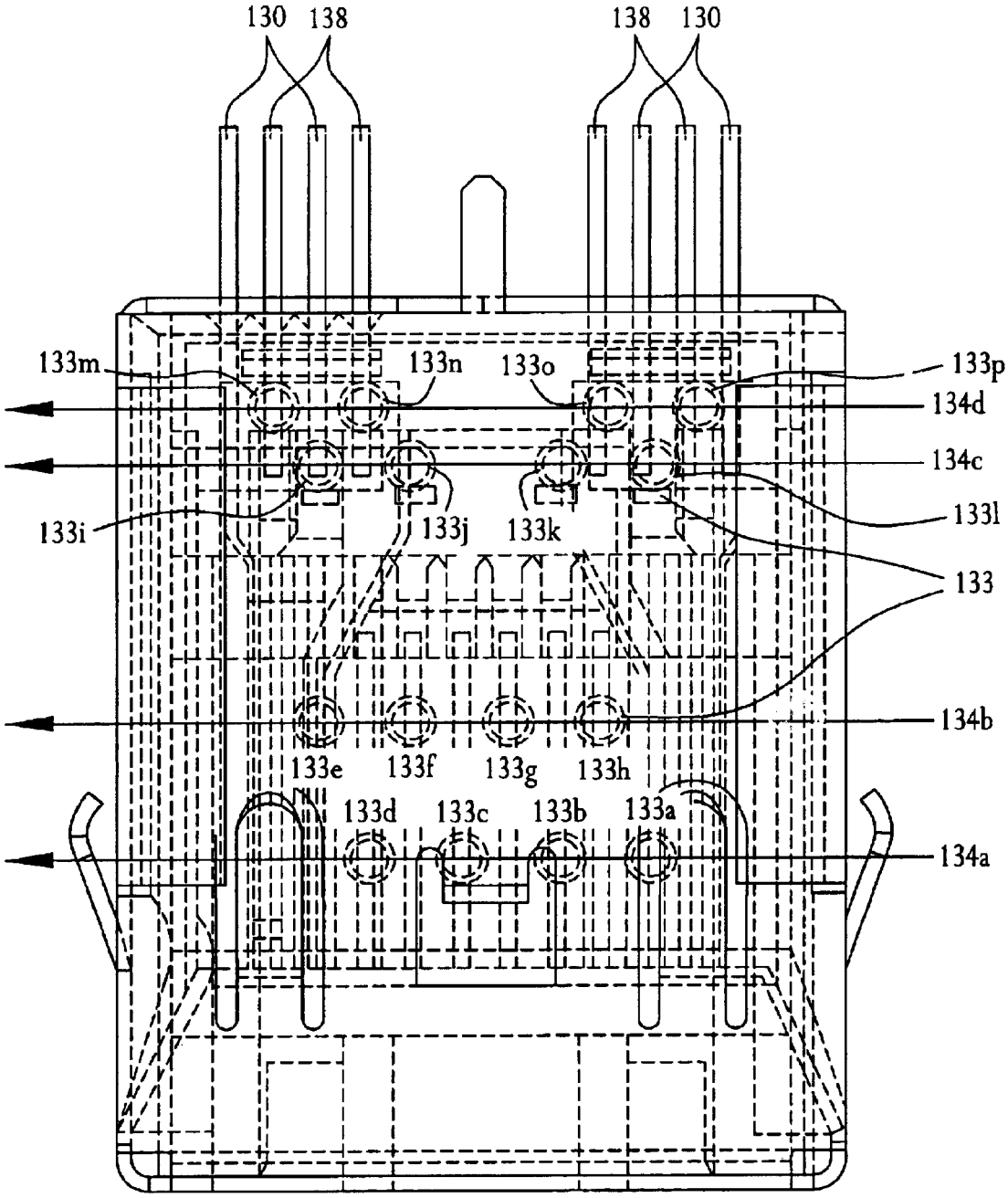
FIG. 10 is a top view of the embodiment of the invention depicted in FIGS. 2–7 with hidden lines illustrating inner components.
Figure 11:
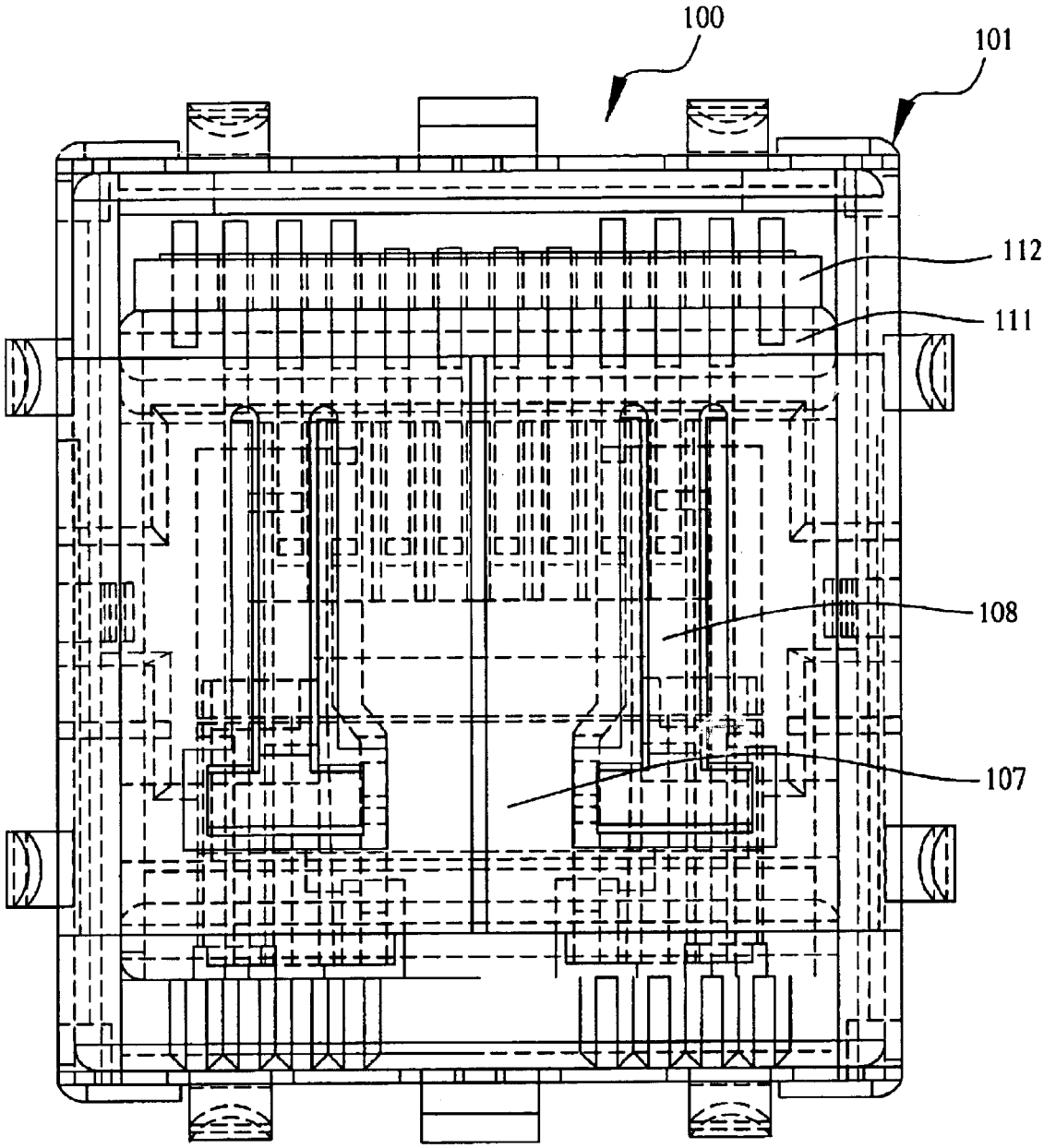
FIG. 11 is a rear view of the embodiment of the invention depicted in FIGS. 2–7 with hidden lines illustrating inner components.

Circuit board sub-assembly 112 is a printed circuit board having inner face 131 and outer face 132. Referring now to FIG. 10, on the inner face 131 of sub-assembly 112 sixteen electrical contacts 133*a*–133*p* (in this case holes in the circuit board) are disposed in four rows 134*a*–134*d*, each row having four of the sixteen electrical contacts 133*a*–133*p*. Rows 134*a* and 134*b* receive the tail end portions of terminal contacts 135, row 134*c* receives the tail end portions of switching contacts 136, and row 134*d* receives the tail end portions of terminal contacts 137. Electrical contacts 133*a*–133*d* in row 134*a* are staggered with respect to electrical contacts 133*e*–133*h* in row 134*b* to minimize crosstalk. Similarly, electrical contacts 133*i*–133*l* in row 134*c* are staggered with respect to electrical contacts 133*m*–133*p* in row 134*d* to minimize crosstalk. Contact 133*e* corresponds to category 2–7 terminal position 1 and is connected to contact 133*m* by an electrical trace (not shown) on board 112. Contact 133*a* corresponds to category 2–7 terminal position 2 and is connected to contact 133*n* by an electrical trace (not shown) on board 112. Contact 133*f* corresponds to category 2–6 terminal position 3 and is connected to contact 133*i* by an electrical trace (not shown) on board 112. Contact 133*b* corresponds to category 2–6 terminal position 4 and is connected to contact 133*k* by an electrical trace (not shown) on board 112. Contact 133*g* corresponds to category 2–6 terminal position 5 and is connected to contact 133*d* by an electrical trace (not shown) on board 112. Contact 133*c* corresponds to category 2–6 terminal position 6 and is connected to contact 133*j* by an electrical trace (not shown) on board 112. Contact 133*h* corresponds to category 2–7 terminal position 7 and is connected to contact 133*o* by an electrical trace (not shown) on board 112. Contact 133*d* corresponds to category 2–7 terminal position 8 and is connected to contact 133*p* by an electrical trace (not shown) on board 112.

As stated above, terminal contacts 135 are mounted to circuit board sub-assembly 112 via electrical contacts 133*a*–133*h*. Referring again to FIGS. 2 and 8, each terminal contact 135 comprises a spring beam portion 135*a* and a tail end portion 135*b*. The spring beam portion 135*a* of each terminal contact 135 extends in cantilever fashion from inner face 131 into plug receiving cavity 103. Also mounted to board 112 are four parallel switching contacts 136. Each switching contact 136 comprises a tail end portion 136*a*, an intermediate portion 136*b*, and a mating portion 136*c*. Each tail end portion 136*a* of switching contacts 136 is mounted to one of electrical contacts 133*i*–133*l* in row 134*c* , positioning each intermediate section 136*b* to extend in finger-like fashion over the outer face of shield insert third wall 118 so that mating portion 136*c* touches or rests on a single contact switching pad 129. Still further, mounted to board 112 are 4 parallel terminal contacts 137. Each terminal contact 137 comprises a front end portion and a tail end portion 137*b*. Each tail end portion 137*b* of terminal contacts 137 is mounted to one of electrical contacts 133*m*–133*p* in row 134*d*. Each front end portion 137*a* of terminal contacts 137 extends beyond the outer face of shield insert third wall and through ground shield mounting face 107 to form a terminal post 138.

Figure 4:
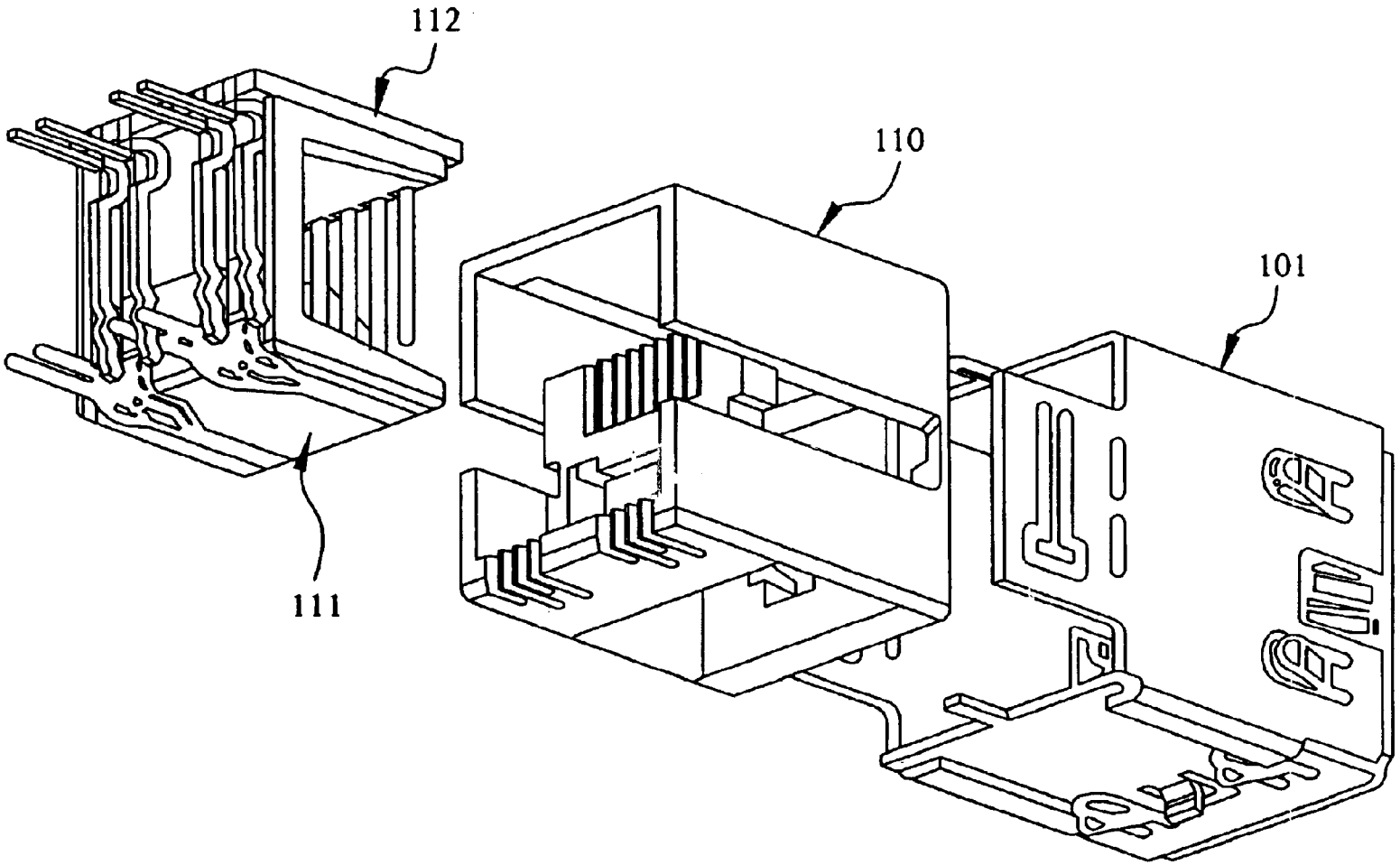
Figure 5:
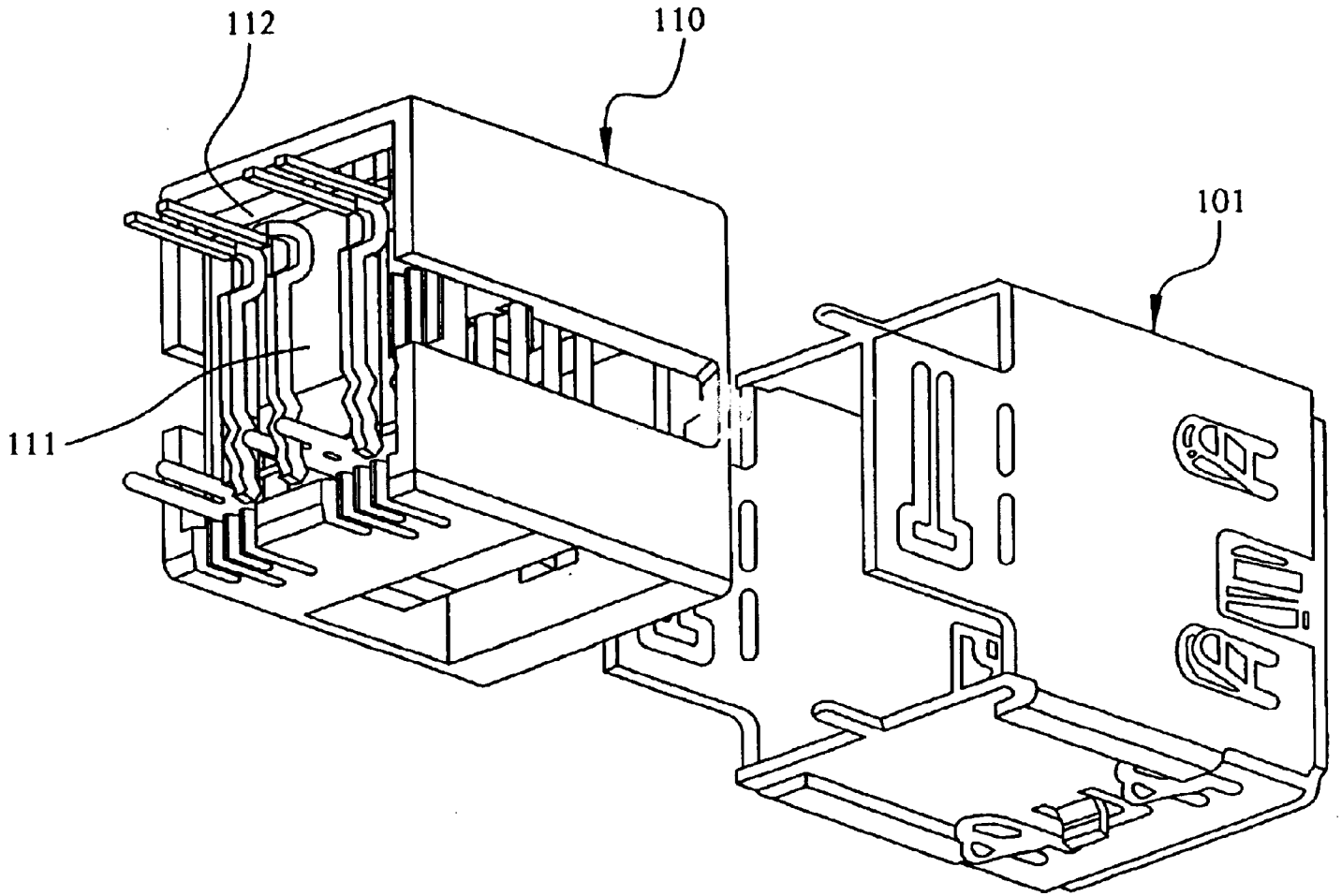

During assembly, once terminal contacts 135 and 137 and switching contacts 136 are mounted to circuit board sub-assembly 112, the package of components are mounted in shield insert 111 assembly receiving recess 125 by moving the package of components in the direction of arrow D. FIG. 4 depicts jack 100 with circuit board sub-assembly 112 mounted in assembly receiving recess 125. Shield insert 111 is then mounted in insert receiving cavity 115 by moving shield insert 111 in the direction of arrow B. FIG. 5 depicts jack 100 with shield insert 111 mounted in insert receiving cavity 115 of dielectric housing 110. Dielectric housing 110 is then mounted in ground shield 101 by moving dielectric housing 110 in the direction of arrow A. FIG. 6 depicts jack 100 with dielectric housing mounted in ground shield 101.

Figure 7:
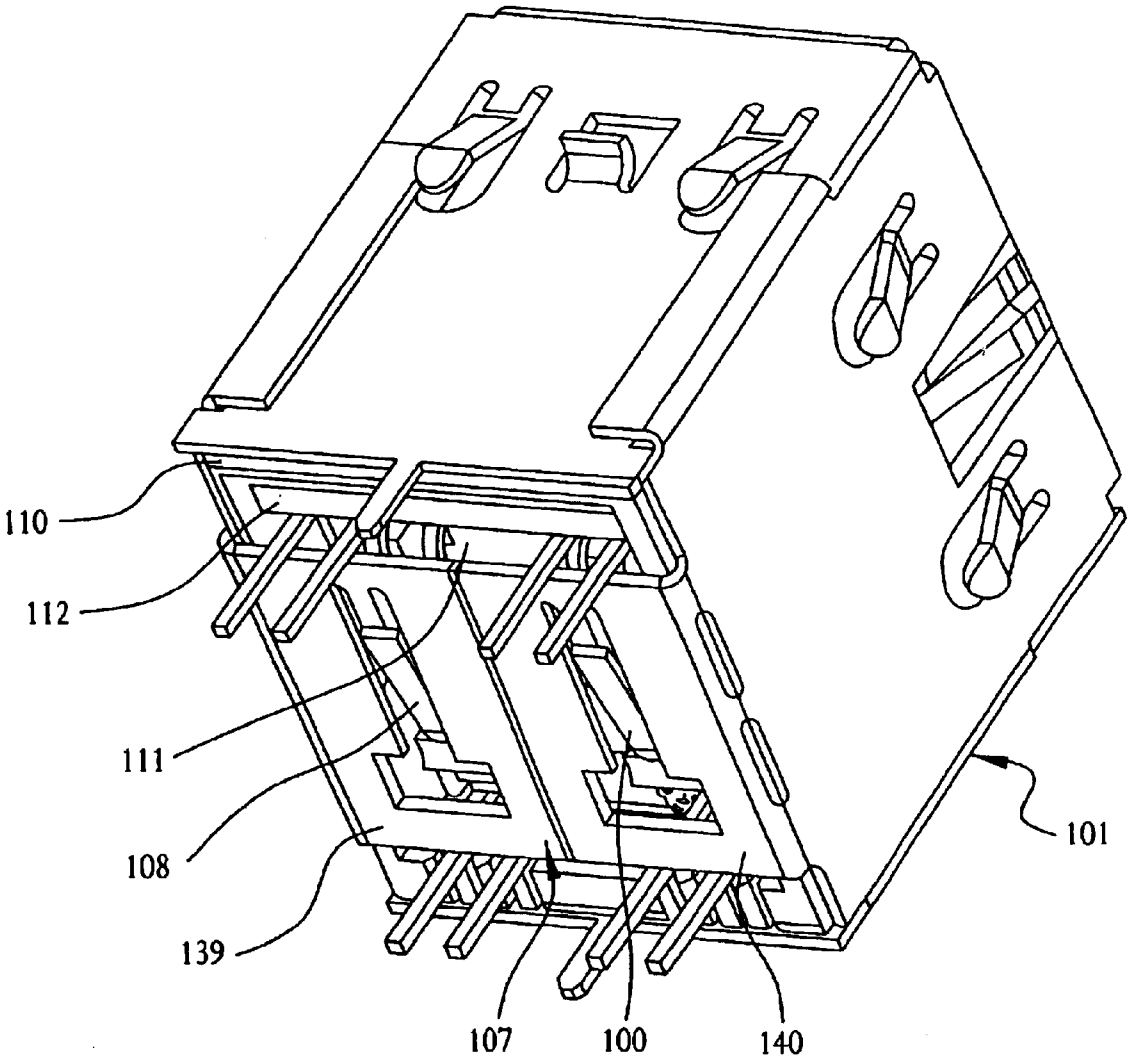

Finally, ground shield rear wall segments 139 and 140 are bent approximately ninety degrees to form mounting face 107 of ground shield 101. FIG. 7 depicts jack 100 in its final stage of assembly.

In operation, without a category 7 plug inserted in plug receiving cavity 103, jack 100 is operates as a category 2–6 compliant plug. Signal paths for category 2–6 positions 1 and 2 are created through the terminal contacts 135 mounted to electrical contacts 133*e* and 133*a*, the electrical traces from contacts 133*e* and 133*a* to electrical contacts 133*m* and 133*n*, and the terminal contacts 137 mounted to electrical contacts 133*m* and 133*n* respectively. Signal paths for category 2–6 positions 3–6 are created through the terminal contacts 135 mounted to electrical contacts 133*f*, 133*b*, 133*g*, and 133*c*, the electrical traces from contacts 133*f*, 133*b*, 133*g*, and 133*c* to electrical contacts 133*i*, 133*k*, 133*l*, and 133*j*, and the switching contacts 136 mounted to electrical contacts 133*i*, 133*k*, 133*l*, and 133*j* which touch contact switching pads 129 on terminal contacts 105 respectively. Signal paths for category 2–6 positions 7 and 8 are created through the terminal contacts 135 mounted to electrical contacts 133*h* and 133*d*, the electrical traces from contacts 133*h* and 133*d* to electrical contacts 133*o* and 133*p*, and the terminal contacts 137 mounted to electrical contacts 133*o* and 133*p* respectively.

With a category 7 plug inserted in plug receiving cavity 103 jack 100 operates as a category 7 compliant plug and the terminal contacts 135 corresponding to category 2–6 positions 3–6 are grounded to prevent crosstalk. Signal paths for category 7 positions 1 and 2 are the same signal paths as described above for category 2–6 positions 1 and 2. Signal paths for category 7 positions 3–6 are provided by terminal contacts 105. Signal paths for category 7 positions 7 and 8 are the same signal paths as described above for category 2–6 positions 7 and 8. The terminal contacts 135 corresponding to category 2–6 positions 3–6 are grounded by operation of switching block 113 and switching contacts 136. Insertion of a category 7 plug into plug receiving cavity 103 results in a protrusion on the lower front face of the plug engaging the front surface of switching block 113, causing switching block 113 to slide towards ground shield mounting face 107. The movement of switching block 113 towards ground shield mounting face 107 causes the rear surface of switching block 112 to engage the intermediate 136*b* and/or mating portions 136*c* of switching contacts 136, lifting mating portions 136*c* off contact switching pads 129 and causing mating poritions 136*c* to touch ground shield grounding springs 108.

While the invention has been described in connection with the certain embodiments depicted in the various figures, it is to be understood that other similar embodiments may be used or modifications and additions may be made to the described embodiments for performing the same function of the invention without deviating therefrom. For example, the invention need not be embodied in a category 2–7 compliant jack but may be embodied in any jack where there is a need to switch between differing pluralities of terminal contacts. Therefore, the invention should not be limited to any single embodiment, but rather construed in breadth and scope in accordance with the claims appended below.

We claim:

1. A modular jack connector, comprising:

a ground shield defining a receiving cavity open at a plug receiving face;

a dielectric housing mounted inside the ground shield receiving cavity, the dielectric housing defining a plug receiving cavity open on a first face thereof and an insert receiving cavity open to said plug receiving cavity;

a plurality of first terminal contacts mounted to said dielectric housing, each of said first terminal contacts having a spring beam and tail end portion, wherein the spring beam portion extends within the plug receiving cavity;

a plurality of second terminal contacts mounted to said dielectric housing, each second terminal contact having a spring beam and tail end portion, wherein the spring beam portion extends within the plug receiving cavity and wherein certain of said tail end portions of said second terminal contacts are electrically connected to certain of said tail end portions of said first terminal contacts; and a switching block positioned to slideably move within said insert receiving cavity;

whereby insertion of a plug having a switching protrusion into the plug receiving cavity of the connector contacts and moves the switching block away from said plug receiving cavity breaking said electrical connections.

2. The connector of claim 1, wherein said first terminal contacts comprise positions 1–8 of a Category 3–6 compliant plug.

3. The connector of claim 1, wherein said certain first terminal contacts comprise positions 3–6 of a Category 3–6 compliant plug.

4. The connector of claim 1, wherein said certain second terminal contacts comprise positions 3–6 of a Category 7 compliant plug.

5. The connector of claim 1, wherein said plurality of first terminal contacts are mounted in a plurality of first contact receiving recesses in said dielectric housing and said plurality of second terminal contacts are mounted in a plurality of second contact receiving recesses.

6. The connector of claim 5, wherein said contact receiving recesses are substantially separated from each other.

7. The connector of claim 1, wherein said certain of said tail end portions of said second terminals are electrically connected to said certain of said tail end portions of said first terminal contacts by a plurality of switching contacts.

8. The connector of claim 7, wherein said electrical connections are broken by said switching block engaging said switching contacts.

9. The connector of claim 7, wherein each of said certain tail end portions of said first terminal contacts further comprise a switching pad and each of said switching contacts comprise a mating portion, said switch pad being in electrical contact with at least one mating pad.

10. The connector of claim 9, wherein said electrical connections are broken by said switching block engaging said switching contacts and breaking the electrical connection between said first terminal switching pads and said switching contact mating pads.

11. The connector of claim 1, wherein said certain of said first terminal contacts are electrically grounded when said electrical connections between said certain first and second terminal contacts are broken.

12. The connector of claim 11, wherein said grounding shield further defines a plurality of grounding springs extending inwardly towards said dielectric housing, said certain of said first terminal contacts being electrically connected to said grounding springs when said electrical connections between said certain first and second terminal contacts are broken.

13. A method for converting a jack from a first category of compliance to a second category of compliance, said jack comprising a switching block slideably mounted within an insert receiving cavity, and a plurality of first and second terminal contacts extending into a plug receiving cavity, certain of said first terminal contacts being electrically connected to certain of said second terminal contacts, said method comprising inserting a plug having a switching protrusion into said plug receiving cavity, said inserting causing said switching protrusion to engage and move said switching block within said insert receiving cavity, said moving of said switching block breaking said electrical connections.

14. The method of claim 13, wherein said certain second terminal contacts are electrically connected to said certain first terminal contacts by a plurality of switching contacts.

15. The method of claim 13, wherein said electrical connections are broken by said switching block engaging said switching contacts.

16. The connector of claim 13, wherein said first terminal contacts comprise positions 1–8 of a Category 3–6 compliant plug.

17. The connector of claim 13, wherein said certain first terminal contacts comprise positions 3–6 of a Category 3–6 compliant plug.

18. The connector of claim 13, wherein said certain second terminal contacts comprise positions 3–6 of a Category 7 compliant plug.

19. The method of claim 13, wherein said certain first terminal contacts are electrically grounded when said electrical connections are broken.

20. The method of claim 19, wherein said jack further comprises a grounding shield and a plurality of grounding springs extending inwardly towards said plug receiving cavity, said certain first terminal contacts being electrically connected to said grounding springs when said electrical connections between said certain first and second terminal contacts are broken.

21. A modular jack connector, comprising:

a ground shield defining a receiving cavity open at a plug receiving face;

a dielectric housing mounted inside the ground shield receiving cavity, the dielectric housing defining a plug receiving cavity open on a first face thereof and an insert receiving cavity open to said plug receiving cavity;

a plurality of first terminal contacts mounted to said dielectric housing, each of said first terminal contacts having a spring beam and tail end portion, wherein the spring beam portion extends within the plug receiving cavity;

a plurality of second terminal contacts mounted to said dielectric housing, each second terminal contact having a spring beam and tail end portion, wherein the spring beam portion extends within the plug receiving cavity and wherein certain of said tail end portions of said second terminal contacts are directly electrically connected to certain of said tail end portions of said first terminal contacts; and a switching block positioned to slideably move within said insert receiving cavity;

whereby insertion of a plug having a switching protrusion into the plug receiving cavity of the connector contacts and moves the switching block away from said plug receiving cavity breaking said electrical connections.

22. The connector of claim 21, wherein said first terminal contacts comprise positions 1–8 of a Category 3–6 compliant plug.

23. The connector of claim 21, wherein said certain first terminal contacts comprise positions 3–6 of a Category 3–6 compliant plug.

24. The connector of claim 21, wherein said certain second terminal contacts comprise positions 3–6 of a Category 7 compliant plug.

25. The connector of claim 21, wherein said plurality of first terminal contacts are mounted in a plurality of first contact receiving recesses in said dielectric housing and said plurality of second terminal contacts are mounted in a plurality of second contact receiving recesses.

26. The connector of claim 25, wherein said contact receiving recesses are substantially separated from each other.

27. The connector of claim 21, wherein said certain of said tail end portions of said second terminals are electrically connected to said certain of said tail end portions of said first terminal contacts by a plurality of switching contacts.

28. The connector of claim 27, wherein said electrical connections are broken by said switching block engaging said switching contacts.

29. The connector of claim 27, wherein each of said certain tail end portions of said first terminal contacts further comprise a switching pad and each of said switching contacts comprise a mating portion, said switch pad being in electrical contact with at least one mating pad.

30. The connector of claim 29, wherein said electrical connections are broken by said switching block engaging said switching contacts and breaking the electrical connection between said first terminal switching pads and said switching contact mating pads.

31. The connector of claim 21, wherein said certain of said first terminal contacts are electrically grounded when said electrical connections between said certain first and second terminal contacts are broken.

32. The connector of claim 31, wherein said grounding shield further defines a plurality of grounding springs extending inwardly towards said dielectric housing, said certain of said first terminal contacts being electrically connected to said grounding springs when said electrical connections between said certain first and second terminal contacts are broken.

33. A method for converting a jack from a first category of compliance to a second category of compliance, said jack comprising a switching block slideably mounted within an insert receiving cavity, and a plurality of first and second terminal contacts extending into a plug receiving cavity, certain of said first terminal contacts being directly electrically connected to certain of said second terminal contacts, said method comprising inserting a plug having a switching protrusion into said plug receiving cavity, said inserting causing said switching protrusion to engage and move said switching block within said insert receiving cavity, said moving of said switching block breaking said electrical connections.

34. The method of claim 33, wherein said certain second terminal contacts are electrically connected to said certain first terminal contacts by a plurality of switching contacts.

35. The method of claim 33, wherein said electrical connections are broken by said switching block engaging said switching contacts.

36. The connector of claim 33, wherein said first terminal contacts comprise positions 1–8 of a Category 3–6 compliant plug.

37. The connector of claim 33, wherein said certain first terminal contacts comprise positions 3–6 of a Category 3–6 compliant plug.

38. The connector of claim 33, wherein said certain second terminal contacts comprise positions 3–6 of a Category 7 compliant plug.

39. The method of claim 33, wherein said certain first terminal contacts are electrically grounded when said electrical connections are broken.

40. The method of claim 39, wherein said jack further comprises a grounding shield and a plurality of grounding springs extending inwardly towards said plug receiving cavity, said certain first terminal contacts being electrically connected to said grounding springs when said electrical connections between said certain first and second terminal contacts are broken.

41. A modular jack connector, comprising:

a ground shield defining a receiving cavity open at a plug receiving face;

a dielectric housing mounted inside the ground shield receiving cavity, the dielectric housing defining a plug receiving cavity open on a first face thereof and an insert receiving cavity open to said plug receiving cavity;

a plurality of first terminal contacts mounted to said dielectric housing, each of said first terminal contacts having a spring beam and tail end portion, wherein the spring beam portion extends within the plug receiving cavity;

a plurality of second terminal contacts mounted to said dielectric housing, each second terminal contact having a spring beam and tail end portion, wherein the spring beam portion extends within the plug receiving cavity and wherein certain of said tail end portions of said second terminal contacts are electrically connected to certain of said tail end portions of said first terminal contacts; and a switching block positioned to slideably move within said insert receiving cavity; whereby insertion of a plug having a switching protrusion into the plug receiving cavity of the connector contacts and moves the switching block away from said plug receiving cavity breaking said electrical connections; wherein said certain of said first terminal contacts are electrically grounded when said electrical connections between said certain first and second terminal contacts are broken and said grounding shield further defines a plurality of grounding springs extending inwardly towards said dielectric housing, said certain of said first terminal contacts being electrically connected to said grounding springs when said electrical connections between said certain first and second terminal contacts are broken.

42. A method for converting a jack from a first category of compliance to a second category of compliance, said jack comprising a switching block slideably mounted within an insert receiving cavity, and a plurality of first and second terminal contacts extending into a plug receiving cavity, certain of said first terminal contacts being electrically connected to certain of said second terminal contacts, said method comprising inserting a plug having a switching protrusion into said plug receiving cavity, said inserting causing said switching protrusion to engage and move said switching block within said insert receiving cavity, said moving of said switching block breaking said electrical connections; wherein said certain first terminal contacts are electrically grounded when said electrical connections are broken and said jack further comprises a grounding shield and a plurality of grounding springs extending inwardly towards said plug receiving cavity, said certain first terminal contacts being electrically connected to said grounding springs when said electrical connections between said certain first and second terminal contacts are broken.

* * * * *